United States Patent [19]

Pan

[11] Patent Number: 4,998,644

[45] Date of Patent: Mar. 12, 1991

[54] TOOTHPICK DISPENSER

[75] Inventor: Hsu C. Pan, Tan-Tze, Taiwan

[73] Assignee: Palomar Importer & Wholesaler Co. Inc., San Diego, Calif.

[21] Appl. No.: 375,676

[22] Filed: Jul. 5, 1989

[51] Int. Cl.[5] ..... A47G 21/12; B65D 83/02

[52] U.S. Cl. ..... 221/24; 221/234

[58] Field of Search ..... 221/24, 234, 192

[56] References Cited

U.S. PATENT DOCUMENTS

| | | | |
|---|---|---|---|
| 1,361,857 | 12/1920 | Hille | 221/24 |
| 2,562,666 | 7/1951 | Gustafson et al. | 221/24 X |
| 2,954,143 | 9/1960 | Adams | 221/24 |

FOREIGN PATENT DOCUMENTS

| | | | |
|---|---|---|---|
| 261453 | 8/1949 | Switzerland | 221/24 |

*Primary Examiner*—F. J. Bartuska

*Attorney, Agent, or Firm*—Ralph S. Branscomb

[57] ABSTRACT

A toothpick dispenser utilizes a sliding tray which holds one toothpick which it receives from an overlying hopper and then slides out into an accessible position in which a pivotal toothpick gripper in the form of a woodpecker, in the preferred embodiment, simultaneously pivots down, gripping the toothpick in its beak, and then pivots back into the upright position to offer the toothpick to the user.

1 Claim, 2 Drawing Sheets

TOOTHPICK DISPENSER

BACKGROUND OF THE INVENTION

Toothpicks have been popular for many decades, and the means of dispensing them are numerous and creative. The most basic toothpick dispenser, aside from the open box of toothpicks, is one in which a knob is twisted, dispensing a toothpick into a pair of extended arms every time the knob is rotate. This dispenser is simple and effective.

Beyond this simple dispenser, there are many fanciful mechanisms and designs having the ostensible purpose of dispensing toothpicks, but which in fact are in addition conversation pieces, and in some cases esoteric pieces of engineering.

The instant invention falls within the latter category. Rather than simply offering a toothpick up for the user, the dispenser provides much more manipulative stimulation and interest. It concludes a pivotal caricature of a woodpecker which swings down and picks up a toothpick in its beak from a tray which simultaneously moves out offering the toothpick to the woodpecker as the woodpecker swings down. The woodpecker swings down as someone presses down on its head, executing an arc of about two inches, and then returning under spring pressure into its upright position, holding a toothpick wedged in its beak, offered for the user.

Although perhaps the tray could be used by itself, with some lever that could be depressed instead of the woodpecker to actuate it, it would not have nearly the interest and novelty value as the instant invention, utilizing the woodpecker to swing down under hand pressure to mate up precisely with a toothpick extended on the tray, and then raise it up into upright position, offering it to the user.

DETAILED DESCRIPTION OF THE PREFERRED EMBODIMENT

The invention is mounted on and in a housing 10 which has a cylindrical lower base portion 12 and an upper base portion 14 which is cylindrical except for the flat step 16 which defines the front wall of toothpick hopper 18 which is inset into the upper base portion.

Figure 8:
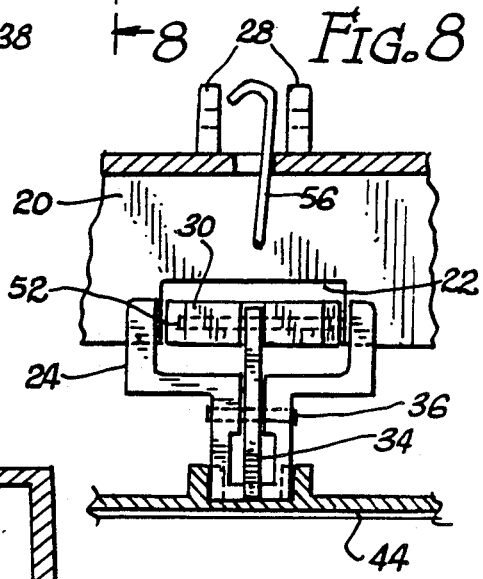
FIG. 8 is a section taken along line 8—8 of FIG. 6.

Also mounted internally of the base is a vertical wall 20 with a wide, central clearance notch 22 best seen in FIG. 8. Engaged astraddle this notch is a depending, slingshot-shaped mounting bracket 24 which could have been molded integrally with the wall 20 inasmuch as it is stationary and only serves the purpose of mounting the moving structure detailed below.

Figure 7:
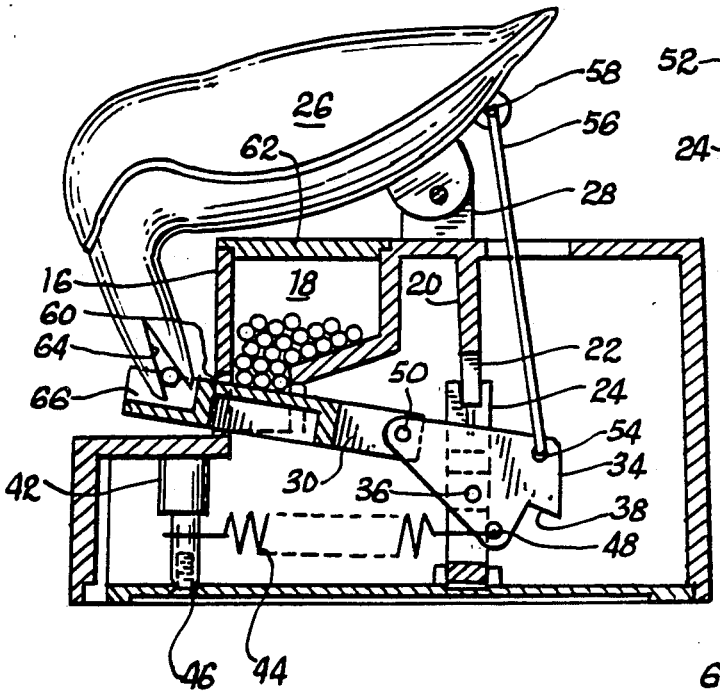
FIG. 7 is a section taken along line 7—7 of FIG. 2.

The idea is for the bird 26 to swing down, pivoted between a pair of tabs 28, in such a fashion that the tray 30 is simultaneously extending out into a presentation mode shown in FIG. 7 with a toothpick in the holder 32. The tray is best visualized from FIG. 9.

With reference to FIGS. 6 through 9 the coordinated motion is accomplished through a pivot plate 34 which itself is pivoted at 36 between the lower sides of the mounting bracket 24, as best seen in FIG. 8.

Figure 6:
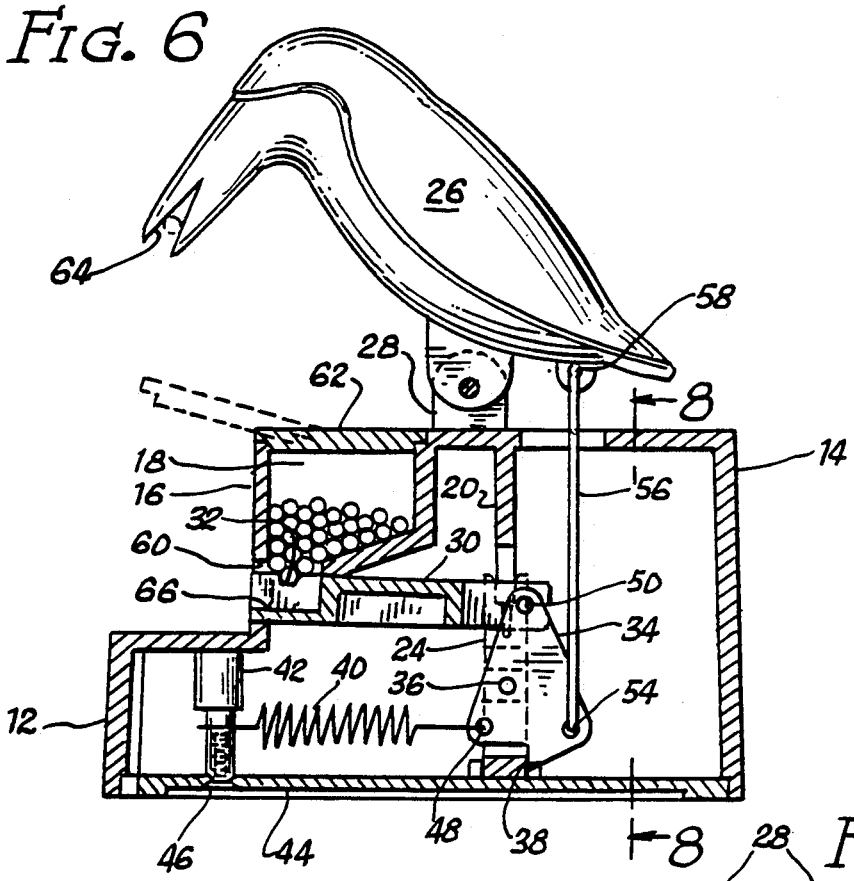
FIG. 6 is a section taken along line 6—6 of FIG. 1.

This pivot plate is free to pivot, with the exception that it defines a stop shoulder 38 which butts against the bottom of the mounting bracket 24 as shown in FIG. 6, to stop the clockwise pivotal action.

Eccentric of the central pivot 36 are three mounting points on the pivot plate 34. First, a spring 40 provides all of the biasing for the mechanism of the toothpick dispenser. It is engaged forwardly on a peg 42 which depends from the housing 10 to which it is molded, and is supported at its bottom by the bottom cover plate 44, which is retained in place by a single screw 46 which screws into the bottom of the peg 42. The spring attaches to the bottom of the pivot plate at 48, causing the plate to want to rotate in the clockwise direction.

Figure 9:
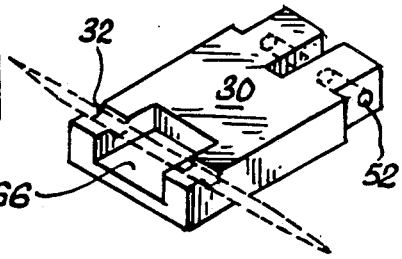
FIG. 9 is a perspective view of the toothpick tray.

The second attachment point on the pivot plate is at 50, where the plate is pivoted on a shaft 52 through the rear of the tray, as best seen in FIG. 9. It can be seen by studying FIGS. 6 and 7 that as the pivot plate moves from the position of FIG. 6 to the position of FIG. 7, the tray will move from a position in which its front edge is flush with the step 16 of the base, to a position in which the tray is extended as shown in FIG. 7. It should be noted that because of the geometry of the situation, the tray will not exit exactly horizontally, but strikes a slight angle as shown in FIG. 7.

The third pivot point is at 54, at which a rod 56 defines a hooked end which engages through the hole in the pivot plate. The rod connects at its upper end to the tail end of the bird 26. The bird is a woodpecker in the preferred embodiment, but clearly could be another kind of bird, another animal, or anything for that matter.

Describing the operation of one cycle of the invention, as shown in FIG. 6, the hopper has an opening at 60 at its bottom which provides access to the toothpicks for the toothpick holder 32. The toothpick holder is just the right size to accept one toothpick and no more. The toothpick must be put in the hopper in the parallel orientation shown in FIG. 6, and are covered with a cover 62 which is flush with the top of the base housing 10.

Figure 1:
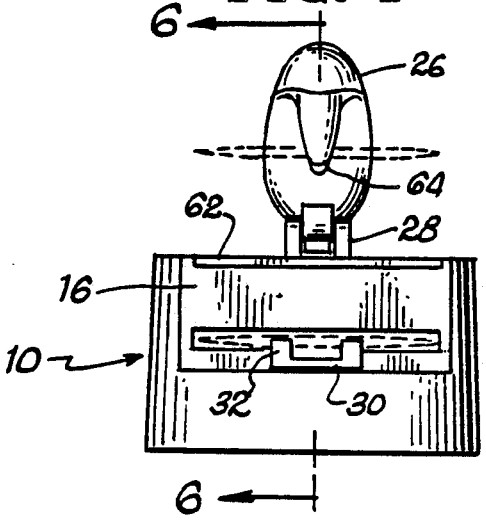
FIG. 1 is a front elevation view of the toothpick dispenser.
Figure 2:
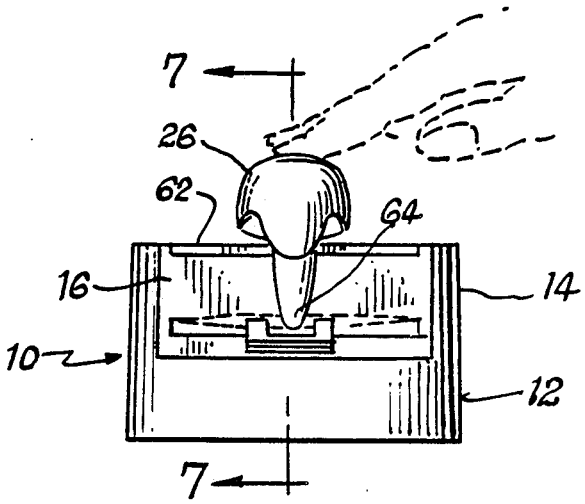
FIG. 2 is a view identical to FIG. 1 but with the woodpecker being pressed down to wedge a toothpick in its beak.
Figure 3:
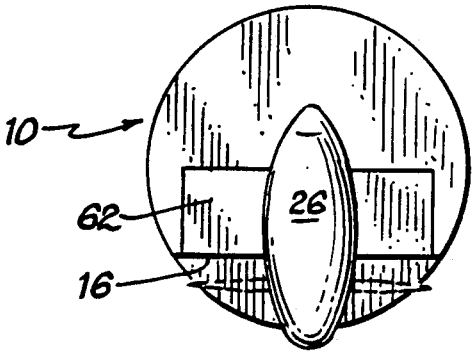
FIG. 3 is a top view of the dispenser as shown in FIG. 2.
Figure 4:
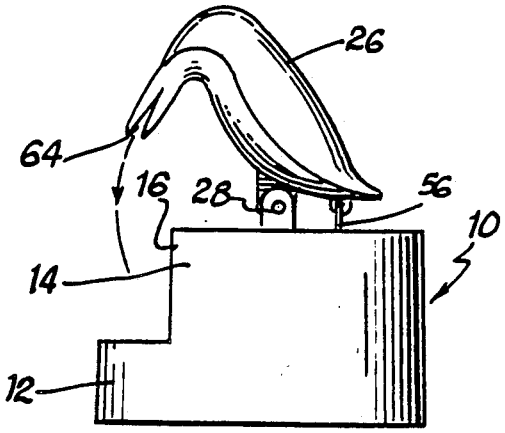
FIG. 4 is a side elevation view of FIG. 1 illustrating the arc of the woodpecker's beak.
Figure 5:
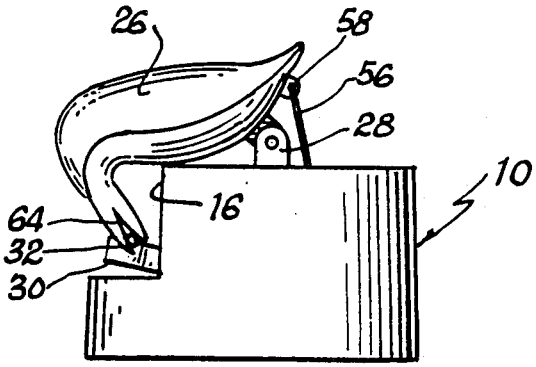
FIG. 5 illustrates the woodpecker in its extended mode engaging a toothpick.

As the bird is pushed down by hand as indicated in FIG. 2, it assumes the extended position shown in FIG. 7. At the same time, the tray moves from its loading position of FIG. 6 to its toothpick presentation position of FIG. 7. The dimensions of the parts are coordinated such that the cleft beak 64 of the bird engages the toothpick quite precisely, as it is extended from the housing 10. Note the clearance space 66, shown in FIG. 9, defined in the tray to provide clearance for the bird's beak as shown in FIG. 7.

Although the mechanism is simple and the number of parts minimal, the dispenser works with remarkable, 100% reliability. The cleft of the beak is such that it never fails to adequately grip a toothpick, and the aperture of the beak is such that despite any fine variations of timing or dimensions, the beak invariably passes down and wedges a toothpick therein. The tray is also designed with sufficiently close tolerances that virtually every time it moves into the loading position and back out again, it will load one toothpick, without jamming and without skipping a cycle.

Thus the design permits the unit to be made from a minimum of inexpensive molded parts to create a result that is precise, reliable, and provides considerable interest to the user beyond the standard, American diner-style toothpick dispenser.

I claim:

1. A toothpick dispenser comprising:

(a) a housing;

(b) a toothpick hopper in said housing;

(c) a tray operatively mounted in said housing, said tray having a holder for a single toothpick, said tray being movable from a loading position in which said holder receives a toothpick from said hopper to a presentation position in which said holder presents a toothpick therein for pickup:

(d) a toothpick gripper pivotally mounted to said housing and being movable from a static position to an extended position in which it grips a toothpick in said holder;

(e) biasing means for biasing said gripper back into its static mode after a toothpick has been gripped thereby;

(f) a coupling mechanism coupling said tray and said toothpick gripper such that movement of said toothpick gripper into said extended position concomitantly moves said tray from a loading position to said presentation position;

(g) said tray being slidable substantially horizontally but with an upward rotation of the extending end from a position with said toothpick holder beneath said hopper to said presentation position, said coupling mechanism including a stationary internal frame member pivotally mounting a pivot plate pivotally connected to said tray and also to a rod connected to said toothpick gripper such that movement of said gripper moves said rod which pivots said plate which moves said tray whereby all movement which extends said tray and lowers said gripper toward said tray is positive and independent of extension spring;

(h) said gripper having a cleft which swings down to wedgingly grip a toothpick in said holder when said gripper is swung into its extended position;

(i) said gripper being in the shape of a bird, and said cleft being defined by the separated mandibles of the bird's beak;

(j) said rod being connected to the tail of said bird; and, (k) said pivotal plate being connected to said biasing means to bias said gripper into the static position and said tray into its loading position.

* * * * *